United States Patent [19]

Hoffman

[11] Patent Number: 4,644,094

[45] Date of Patent: Feb. 17, 1987

[54] CABLE HAVING HAULING, ELECTRICAL AND HYDRAULIC LINES

[75] Inventor: Ernest G. Hoffman, Middlefield, Conn.

[73] Assignee: Harvey Hubbell Incorporated, Orange, Conn.

[21] Appl. No.: 714,272

[22] Filed: Mar. 21, 1985

[51] Int. Cl.[4] ..... H01B 7/18

[52] U.S. Cl. ..... 174/47; 174/102 SP; 174/103; 174/109; 174/115; 174/117 F

[58] Field of Search ..... 174/47, 102 SP, 103, 174/109, 115, 117 F, 131 R

[56] References Cited

U.S. PATENT DOCUMENTS

| | | | |
|---|---|---|---|
| 2,081,634 | 5/1937 | McNamee | 173/264 |
| 2,544,233 | 3/1951 | Kennedy | 174/117 |
| 3,679,812 | 7/1972 | Owens | 174/108 |
| 3,843,829 | 10/1974 | Bridges et al. | 174/36 |
| 4,081,602 | 3/1978 | Paniri et al. | 174/103 |
| 4,196,307 | 4/1980 | Moore et al. | 174/47 |
| 4,262,703 | 4/1981 | Moore et al. | 137/115 |
| 4,315,099 | 2/1982 | Gerardot et al. | 174/47 |
| 4,374,530 | 2/1983 | Walling | 138/110 |
| 4,445,593 | 5/1984 | Coleman et al. | 187/1 R |
| 4,453,035 | 5/1984 | Neuroth | 174/103 |
| 4,453,036 | 6/1984 | Neuroth | 174/103 |
| 4,454,377 | 6/1984 | Neuroth | 174/103 |
| 4,454,378 | 6/1984 | Neuroth | 174/103 |
| 4,490,577 | 12/1984 | Neuroth | 174/103 |
| 4,532,374 | 7/1985 | Neuroth | 174/103 |

FOREIGN PATENT DOCUMENTS

| | | |
|---|---|---|
| 0066910 | 12/1982 | European Pat. Off. . |
| 834955 | 12/1938 | France . |
| 1250823 | 10/1971 | United Kingdom . |

*Primary Examiner*—Arthur T. Grimley
*Assistant Examiner*—Morris H. Nimmo
*Attorney, Agent, or Firm*—Jerry M. Presson; Alfred N. Goodman

[57] ABSTRACT

A reinforced cable having hauling, electrical and hydraulic lines. The cable has a substantially rectangular cross section and includes at least one internal support to protect these lines by resisting external compressive forces, and yet is bendable about one of its transverse axes for easy storage on and deployment from a drum. The internal support also protects the hauling lines from compressive forces applied longitudinally thereof by resisting radial displacement of the hauling lines. In one embodiment, the cable comprises an armor layer, a pair of engaged channels inside the armor layer, and a pair of corrugated supports inside the channels and fixedly spaced apart. The hauling lines, in the form of wire ropes, are located inside the corrugated supports, while the electrical lines are located inside the channels between the corrugated supports. The hydraulic lines can alternatively be located inside the channels between the corrugated supports, or inside the wire ropes. Any spaces inside the channels are filled by elastomeric material. In another embodiment, the cable comprises a rigid tubular support located between and engaging the wire ropes, and an armor layer engaging and enclosing the tubular support and the wire ropes. In this embodiment, the electrical conductor is located inside the tubular support.

37 Claims, 9 Drawing Figures

FIG. 1.
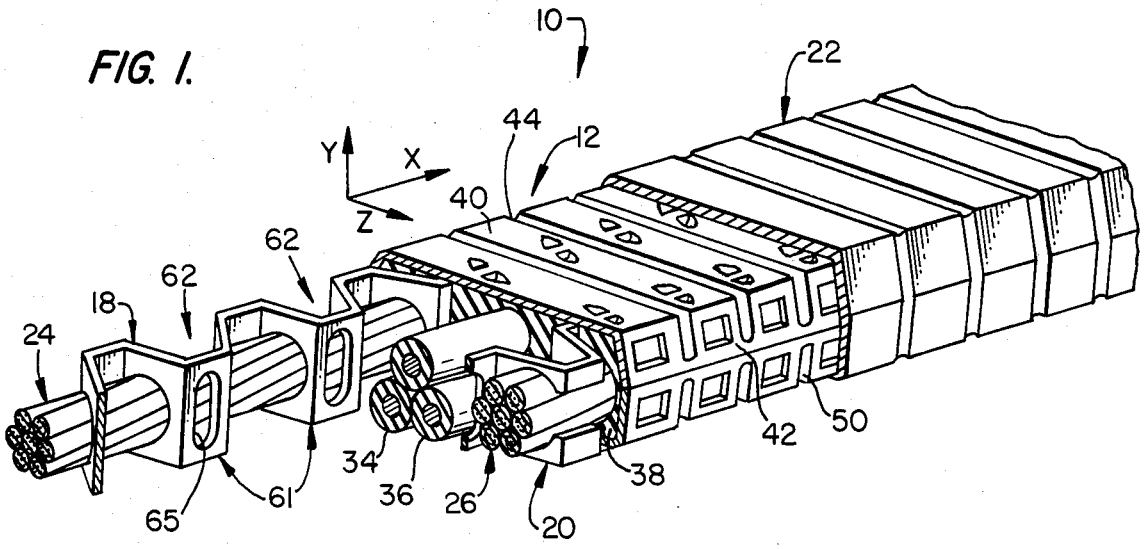
FIG. 2.
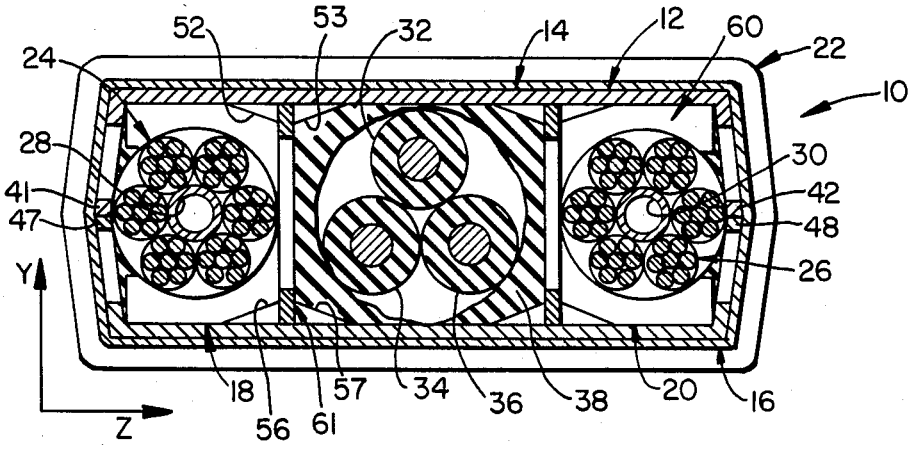
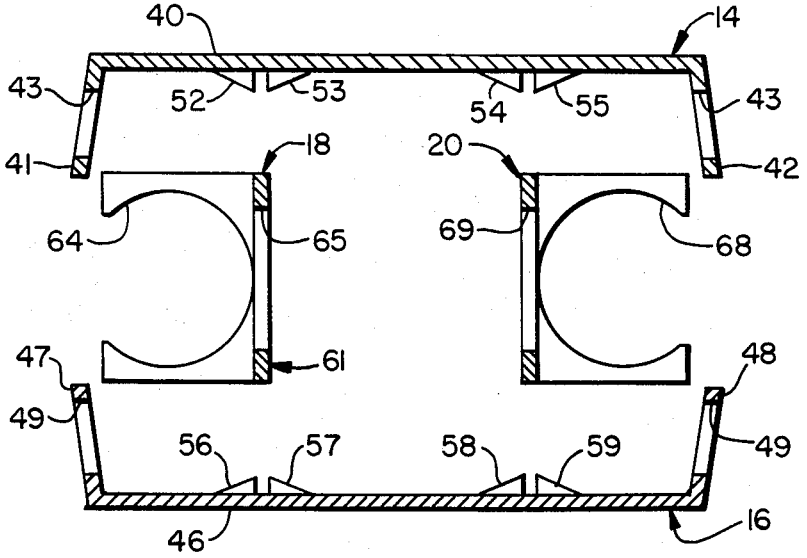
FIG. 3.

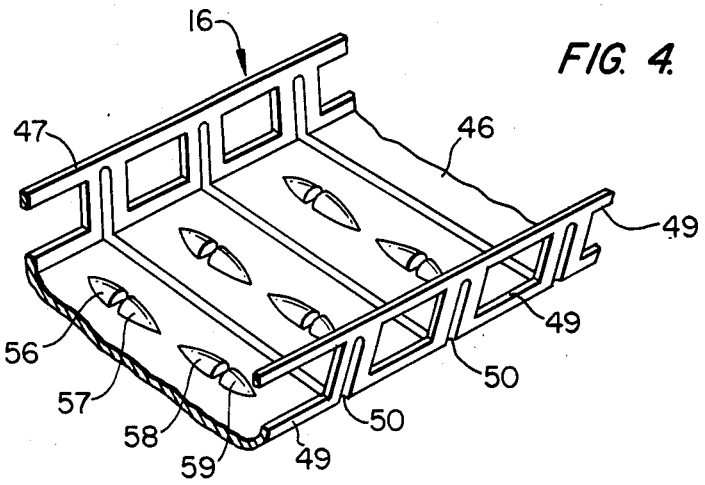
FIG. 4.
FIG. 5.
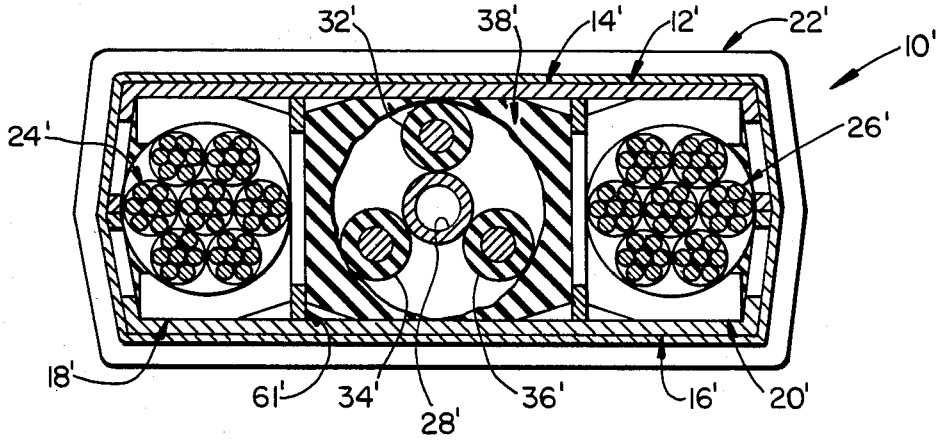
FIG. 6.
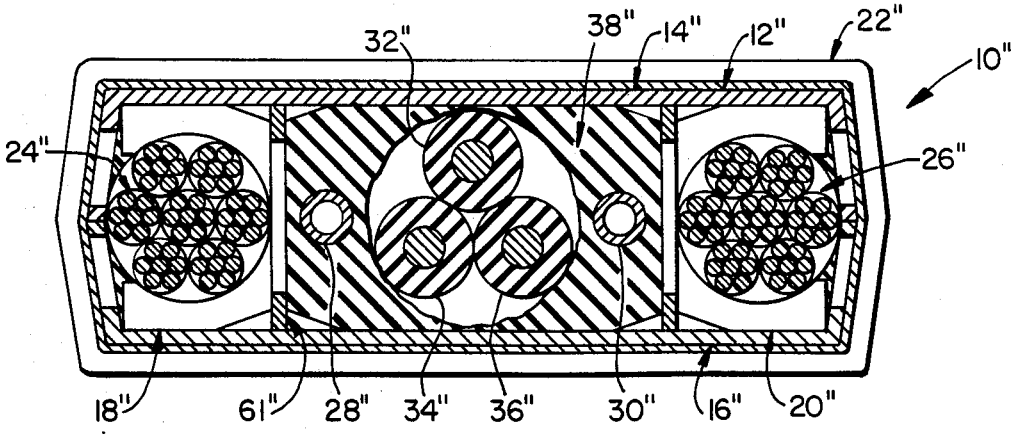

CABLE HAVING HAULING, ELECTRICAL AND HYDRAULIC LINES

FIELD OF THE INVENTION

The invention relates to reinforced cables having hauling, electrical and hydraulic lines therein. These cables are especially useful for deploying, suspending, operating and retrieving pumps in oil wells and for providing hydraulic and electrical power to other downhole equipment. The cable in accordance with the invention includes at least one internal support to resist external compressive forces and yet is bendable about one of its transverse axes for easy storage on and deployment from a drum. The support also resists radial outward displacement of wire rope hauling lines when they experience longitudinal compression.

BACKGROUND OF THE INVENTION

Cable suitable for hauling and power and signal transmission are typically used for the installation, operation and retrieval of electrical submersible pumps used in oil wells. The conventional cable used for this purpose is generally round and comprises a core of the power and signal transmission lines surrounded by helically wound wires. There are, however, four significant disadvantages of these conventional cables.

First, under tension the helically wound wires experience significant inwardly directed forces that stress and can damage the internal core of the cable. Secondly, under compression, the helically wound wires tend to open up outwardly or inwardly, i.e. "birdcage", which distorts the strands of the wires and can inwardly compress and possibly damage the cable core. Thirdly, when such round cables contained by helically wound wires experience elevated temperatures and undergo outward expansion of the core, this again tends to generate destructive compressive stresses within the cable. Finally, these round cables cannot be winched directly onto a drum under high tension because they do not have the ability to carry the resultant high sidewall bearing forces and therefore are easily crushed.

Other prior art cables having hauling and power and signal transmission lines are not easily bendable along the longitudinal axis and therefore are not easily stored on or deployed from a drum. Moreover, many of these cables are rather heavy and therefore do not have a high strength-toweight ratio. They are also bulky, difficult to manufacture, and provide insufficient compression resistance.

Examples of these prior art cables are disclosed in the following U.S. Pat. Nos. 2,544,233 to Kennedy; 3,679,812 to Owens; 3,843,829 to Bridges et al; 4,081,602 to Paniri et al; 4,196,307 and 4,262,703 to Moore et al; 4,374,530 to Walling; 4,445,593 to Coleman et al; and 4,453,035 to Neuroth. In addition, an example of such prior art is disclosed in United Kingdom Pat. No. 1,250,823 to Spencer.

SUMMARY OF THE INVENTION

Accordingly, it is a primary object of the present invention to provide a reinforced cable suitable for hauling and power and signal transmission that has high tensile and compressive strength and separates the hauling lines and reinforcing structure from the power and signal transmission lines.

Another object of the invention is to provide a cable having hauling, electrical and hydraulic lines that resists external compressive impact forces, resists birdcaging under longitudinal compression, and is bendable for easy storage and deployment from a drum.

Another object of the invention is to provide such a cable that has a high strength-to-weight ratio, and is compact and easy to manufacture.

The foregoing objects are basically attained by providing a cable comprising a pair of spaced apart wire ropes, each wire rope comprising a plurality of helically wound strands; an electrical conductor located between the pair of wire ropes; and a containment and reinforcing assembly, coupled to and enclosing the wire ropes and the electrical conductor, for maintaining the wire ropes a fixed distance apart, resisting external compressive forces directed transversely of the electrical conductor along substantially the entire length of said electrical conductor, and resisting radial displacement of the wire rope strands, along substantially the entire length of said wire ropes, during longitudinal compression of the wire ropes, the containment and reinforcing assembly being bendable about an axis transverse thereto.

In the embodiments in FIGS. 1–6, the containment and reinforcing assembly comprises a pair of spaced corrugated supports receiving the wire ropes therein, a pair of engaging channels enclosing the supports and a tubular armor member enclosing the wire ropes, electrical conductor, channels and corrugated supports. In a further embodiment, in FIGS. 7–9, the containment and reinforcing assembly comprises a centrally located tubular support engaging the wire ropes and a tubular armor member enclosing the wire ropes, electrical conductor and tubular support.

Other objects, advantages, and salient features of the present invention will become apparent from the following detailed description, which, taken in conjunction with the annexed drawings, discloses preferred embodiments of the present invention.

DRAWINGS

Referring now to the drawings which form a part of this original disclosure;

FIG. 1 is a right perspective view with parts broken away of the cable in accordance with the present invention;

FIG. 2 is an enlarged transverse cross-sectional view in elevation of the cable shown in FIG. 1 with portions of the elastomeric filler deleted therefrom for clarity;

FIG. 3 is an exploded transverse cross-sectional view in elevation illustrating the upper and lower channels and the first and second supports shown in FIGS. 1 and 2;

FIG. 4 is a right perspective view of one of the channels illustrated in FIGS. 1–3;

FIG. 5 is a transverse cross-sectional view in elevation of a modified embodiment of the cable in accordance with the invention, wherein the hydraulic line is located inside a series of electrical conductors;

FIG. 6 is a transverse cross-sectional view in elevation of another modified embodiment of the invention wherein two hydraulic lines are located in the cable on opposite sides of a series of electrical conductors;

DETAILED DESCRIPTION OF THE INVENTION

Figure 7:
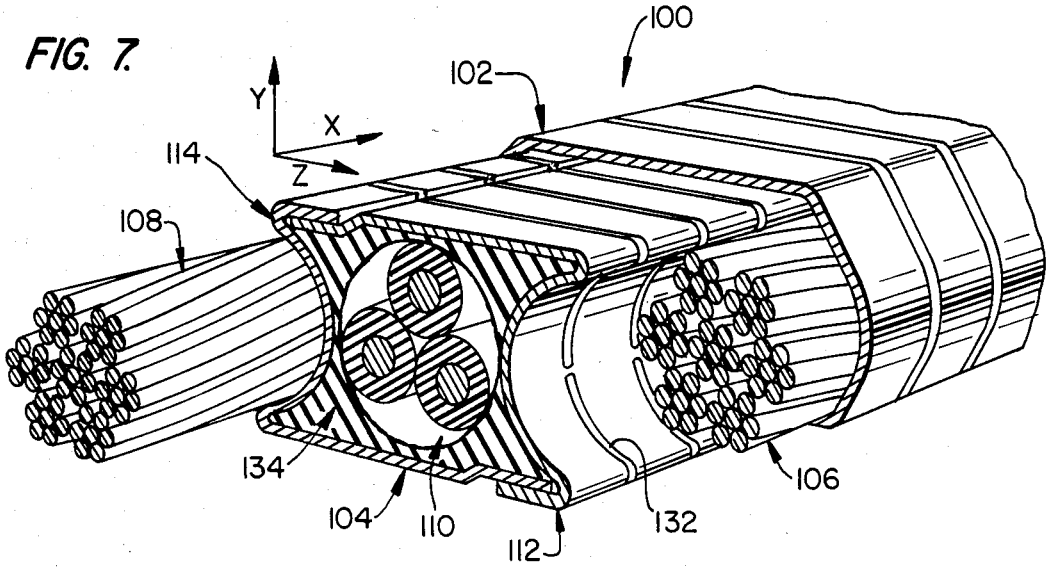
FIG. 7 is a right perspective view with parts broken away of a further modified cable in accordance with the invention using only a single internal tubular support.

As seen in FIGS. 1–4, the cable 10 in accordance with the invention is substantially flat and has a substantially rectangular cross section. Along its entire length, the cable comprises a tubular assembly 12 formed of upper and lower elongated channels 14 and 16, first and second elongated supports 18 and 20 located inside the tubular assembly, armor tape 22 wrapped around the tubular assembly, first and second hauling lines 24 and 26 located inside the first and second supports, first and second hydraulic lines 28 and 30 located inside the first and second hauling lines, and electrical conductors, or power conduits, 32, 34, and 36 located between the first and second supports. As seen in FIGS. 1 and 2, an elastomeric filler 38 is located inside the tubular assembly to fill the spaces therein not otherwise occupied.

As seen best in FIGS. 3 and 4, the upper and lower channels 14 and 16 forming the tubular assembly 12 are substantially identical and therefore only one will be described in detail. Thus, the upper channel 14 is substantially U-shaped in cross section, advantageously formed of metal, and is comprised of a flat central member 40 having first and second legs 41 and 42 extending in the same direction therefrom at the ends. To reduce the weight of the channels, the legs can have a series of spaced cutouts 43 formed therein. To provide bending about the axis transverse of the channel, a plurality of transversely extending slots 44 are formed completely through the central member 40 and partially through each leg.

The lower channel 16 has corresponding central member 46, legs 47 and 48, cutouts 49 and transverse slots 50.

As seen in FIGS. 3 and 4, the central member 40 in the upper channel has formed downwardly therein a first series of spaced retaining stops 52 and 53 and a second series of spaced retaining stops 54 and 55. Similar series of retaining stops 56 and 57 as well as 58 and 59 are inwardly formed on central member 46 in the lower channel. These retaining stops act in conjunction with the channels to fixedly maintain the first and second supports a fixed distance apart, as will be described in more detail hereinafter.

As seen in FIGS. 1 and 2, the upper and lower channels 14 and 16 have their respective legs 41 and 47 as well as legs 42 and 48 directly engaging one another to form an elongated cavity 60 therein. This cavity has a longitudinal length along the X axis, a transverse height along a Y axis and a transverse width along a Z axis, these axes being mutually orthogonal as illustrated in FIGS. 1 and 2. The Y axis intersects the central members 40 and 46 which are parallel and the Z axis intersects the legs on the channels. When so engaged, and wrapped with the armor tape 22 as illustrated in FIGS. 1 and 2, the upper and lower channels are substantially rigid along the Y and Z axes.

The corrugated first and second supports 18 and 20, as illustrated in FIGS. 1–3, form load bearing walls that are strong and light and rigid along the Y and Z axes. Each of the supports is the same and therefore only one will be described in detail. Thus, the first support 18 is advantageously formed of metal as a corrugation comprising a repeating series of ridges 61 and hollows 62. Each of the ridges is substantially U-shaped and formed of transversely and longitudinally oriented planar walls of rectangular shape and a common height. Each of these walls can be connected integrally with adjacent walls through an angle of 90 degrees, although the angle can be greater as illustrated in FIG. 1 since the support is essentially extensible longitudinally and bendable about the Z axis due to the corrugated nature thereof. As best seen in FIG. 3, formed along the X axis of the cavity through the transverse walls of the support 18 is a passageway defined by a series of arcuate openings 64. These openings extend substantially along the Z axis of the cavity, receive the hauling lines therein and include substantially 270 degrees. The inner diameters of the openings are each substantially equal to the outer diameters of the hauling lines so that there is a close fit therein, as seen in FIGS. 1 and 2. As seen in FIGS. 1 and 3, cutouts 65 can be formed in the longitudinally extending walls of the support to decrease its weight.

The second support 20 is formed substantially the same as the first support and is thus corrugated, includes ridges and hollows, has a second passageway extending therein along the X axis including arcuate openings 68, and cutouts 69.

As seen best in FIG. 2, the heights of the supports 18 and 20 along the Y axis are each substantally equal to the distance between the inner surfaces of the opposed central members on the upper and lower channels. Moreover, the walls in the first and second supports which extend along the X axis of the cavity are received between the retaining stops on the upper and lower channels, thereby maintaining the first and second supports a fixed distance apart and at opposite sides of the cavity, with the first hauling line 24 engaging the left hand side of the upper and lower channels and the second hauling line 26 engaging the right hand side of the channels.

As seen in FIGS. 1 and 2, once the upper and lower channels 14 and 16 are engaged, they can be enclosed by engagement of a continuous tubular member in the form of the armor tape 22 thereon. This tape is conventional and comprises a helically wound interlocking flat metal tape that is advantageously applied with tension and is bendable about the Z axis. This tape not only holds the channels together, but is also provides an increased compressive strength to the overall structure of the cable since it produces a hoop stress when applied under tension.

The first and second hauling lines 24 and 26 are, as seen in FIGS. 1 and 2, and discussed above, received via a close fit inside the arcuate openings in the first and second supports. These hauling lines extend along the X axis of the cavity, are parallel and are contained in the plane bisecting the transverse height of the cable, this plane defining a neutral axis of the cable. These hauling lines are symmetrically located in the cable, as best seen in FIG. 2.

Each of the hauling lines is advantageously a helically wound wire rope formed from a plurality of strands, which are in turn formed from a plurality of filaments. Advantageously, the two wire ropes are helically wound in opposite directions to balance the resultant torque in the cable. Since the wire ropes are received in the arcuate openings in the first and second supports, they act as a solid structure which is capable of resisting external compressive forces in the Y and Z directions and thus isolate the electrical conductors from these forces.

The hauling lines 24 and 26 may contain hydraulic lines. As seen in FIG. 2, the first hydraulic line 28 is located inside the first hauling line 24 in the center thereof and the second hydraulic line 30 is located centrally inside the second hauling line 26. These hydraulic lines can provide power or signals to any downhole equipment used with a downhole pump or other equipment. The hydraulic lines are also along the neutral axis of the cable. Advantageously, the strands of each wire rope are wrapped around the hydraulic line to provide added protection thereto.

The electrical conductors 32, 34 and 36 are helically wound around each other and form a triplex electrical line for conducting power or signals through the cable. Each of the electrical conductors is formed from a conventional conducting core surrounded by suitable insulation. While three are shown, more or less can be used as desired. As seen in FIG. 2, the electrical conductors are located between the first and second corrugated supports 18 and 20 and are isolated from the hauling lines by means of these supports.

The elastomeric filler 38 is advantageously formed from rubber or suitable polymeric material and not only fills the spaces inside the cavity 60 not otherwise occupied, but also locks the various parts together to prevent longitudinal slippage of the cable components relative to each other, as well as increasing the corrosion resistance and the blocking of gas flow along the cable.

Since the first and second corrugated supports, the upper and lower channels and the armor tape are bendable about the Z axis, the cable 10 can advantageously be tightly wrapped around a drum and thereby easily deployed via a winch. Because the first and second supports, in combination with the hauling lines, provide load bearing walls that protect the electrical conductors, the cable can be winched directly onto a drum under high tension without the resultant sidewall bearing forces crushing the cable, and also the cable will resist transverse external compressive forces exerted on it during use. Moreover, since the wire ropes are received in the corrugated supports and the channels, which are enclosed in the armor layer, outward or inward radial displacement of the wire ropes' strands is resisted when they experience longitudinal compression.

Embodiment of FIG. 5

The modified cable 10' shown in FIG. 5 is substantially the same as that shown in FIGS. 1–4; however, the hydraulic line 28' is located along the neutral axis of the cable and inside the three electrical conductors 32', 34' and 36'. In addition, the center of the hauling lines 24' and 26' is a strand of wire rather than a hydraulic line. The remaining parts of cable 10' are substantially the same as those illustrated in FIGS. 1–4 and discussed above and are shown with the same reference numerals with the addition of a prime. By placing the hydraulic line 28' between the first and second corrugated supports and away from the hauling lines, it experiences less stress.

Embodiment of FIG. 6

The modified cable 10'' shown in FIG. 6 is substantially the same as that shown in FIGS. 1–4; however, the hydraulic lines 28'' and 30'' are not located inside the hauling lines but instead are located between the corrugated supports by themselves on opposite sides of the centrally located set of electrical conductors 32'', 34'', and 36''. The remaining parts of cable 10'' are substantially the same as those shown in FIGS. 1–4 and discussed above, and bear the same reference numerals with the addition of a double prime. By providing the configuration shown in FIG. 6, the hydraulic lines are totally isolated from the hauling lines and electrical conductors so that they are not interfered with by these lines or conductors. In all events, these hydraulic lines are still maintained along the neutral axis of the cable.

Figure 8:
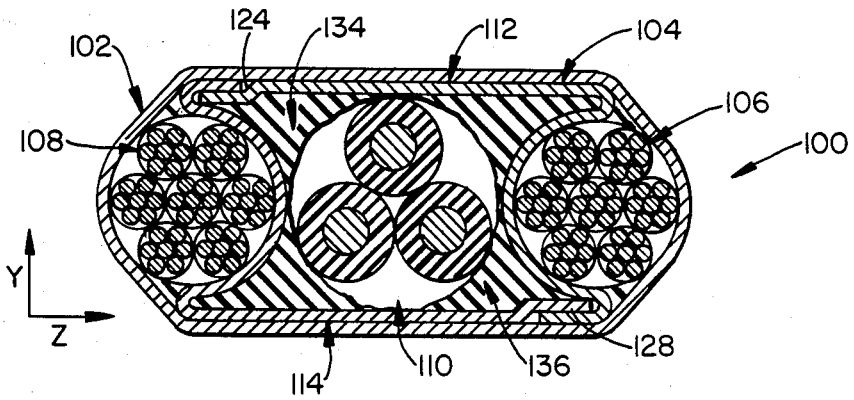
FIG. 8 is a transverse cross-sectional view in elevation of the cable shown in FIG. 7 with portions of the elastomeric filler deleted therefrom for clarity.
Figure 9:
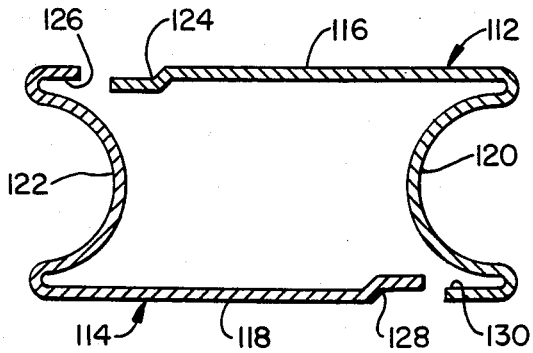
FIG. 9 is an exploded transverse cross-sectional view in elevation illustrating the two channels forming the tubular support shown in FIGS. 8 and 9.

Embodiment of FIGS. 7–9

A further modified cable 100 is shown in FIGS. 7–9 which does not use the corrugated supports or channels shown in FIGS. 1–6. Rather, cable 100 comprises a tubular armor layer 102, a central rigid tubular support 104, a pair of wire ropes 106 and 108, and a triplex electrical conductor 110.

The tubular support 104 comprises a pair of mating channels 112 and 114, which when engaged include parallel, spaced top and bottom planar sections 116 and 118 and parallel, spaced left and right concave side sections 120 and 122. The top and right side sections can be integrally formed to comprise channel 112, and the bottom and left side sections can be integrally formed to comprise channel 114. As seen in FIGS. 7–9, the bent end 124 of top section 116 forms a tongue for reception in slot 126 formed in the left concave side section, while the bent end 128 of bottom section 118 forms a tongue for reception in slot 130 formed in the right concave side section. The resulting closed tubular support, or box, is transversely rigid along the Y and Z axes, but bendable about the Z axis due to transverse slots 132 formed therein as seen in FIG. 7.

The tubular support defines a continuous cavity 134 therein for the reception of the electrical conductor 110. The pair of wire ropes 106 and 108 have parts thereof received, respectively, in the concave side sections 120 and 122 of the tubular portion. Advantageously, half of each wire rope is received in the associated concave side sections to provide additional compression resistance along the Y axis. Thus, the wire ropes are fixedly spaced apart by the tubular support and have the electrical conductor located therebetween.

The armor layer 102 engages and encloses the entire length of the wire ropes and the tubular support, and is advantageously applied under tension to provide significant hoop strength. Elastomeric filler material 136 fills the cable inside the armor tape not otherwise occupied.

Thus, transverse compressive forces directed at the electrical conductor are resisted by the rigid tubular support, wire ropes and armor layer. Moreover, since the wire ropes are enclosed between the armor layer and the two concave sections, outward radial displacement of the wire ropes' strands is resisted when the ropes experience longitudinal compression. In addition, since the outer diameter of the triplex electrical conductor 110, as seen in FIG. 8, is greater than the outer diameter D of the wire ropes, the overall cable has a high weight-to-strength ratio and is also compact. This is also shown in the previous embodiments illustrated in FIGS. 1–6. Likewise, cable 100 is bendable about transverse axis Z, so the cable can be wound on a drum.

As seen in FIGS. 7–9, no hydraulic line is illustrated. However, if desired, one or more hydraulic lines can be added as shown in FIGS. 2, 5, or 6.

While various advantageous embodiments have been chosen to illustrate the invention, it will be understood by those skilled in the art that various changes and modifications can be made therein without departing from the scope of the invention as defined in the appended claims.

What is claimed is:

1. A cable having a longitudinal axis and comprising:

a pair of spaced apart wire ropes extending along said longitudinal axis, each wire rope comprising a plurality of helically wound strands and having an outer diameter D;

a power line located between said pair of wire ropes, extending along said longitudinal axis, and having an outer diameter at least equal to D; and means, coupled to and enclosing said wire ropes and said power line, for maintaining said wire ropes a fixed distance apart, resisting external compressive forces directed transversely of said longitudinal axis and said power line along substantially the entire length of said power line, and resisting radial outward displacement of said wire rope strands, along substantially the entire length of said wire ropes, during longitudinal compression of said wire ropes, said means extending along said longitudinal axis and being bendable about an axis transverse thereto, said means comprising a pair of supports, each receiving one of said wire ropes therein, each of said supports being corrugated.

2. A cable having a longitudinal axis and comprising:

a pair of spaced apart wire ropes extending along said longitudinal axis, each wire rope comprising a plurality of helically wound strands and having an outer diameter D;

a power line located between said pair of wire ropes, extending along said longitudinal axis, and having an outer diameter at least equal to D; and means, coupled to and enclosing said wire ropes and said power line, for maintaining said wire ropes a fixed distance apart, resisting external compressive forces directed transversely of said longitudinal axis and said power line along substantially the entire length of said power line, and resisting radial outward displacement of said wire rope strands, along substantially the entire length of said wire ropes, during longitudinal compression of said wire ropes, said means extending along said longitudinal axis and being bendable about an axis transverse thereto, said means comprising a pair of supports, each of said supports having a passageway receiving one of said wire ropes therein.

3. A cable having a longitudinal axis and comprising:

a pair of spaced apart wire ropes extending along said longitudinal axis, each wire rope comprising a plurality of helically wound strands and having an outer diameter D;

a power line located between said pair of wire ropes, extending along said longitudinal axis, and having an outer diameter at least equal to D; and means, coupled to and enclosing said wire ropes and said power line, for maintaining said wire ropes a fixed distance apart, resisting external compressive forces directed transversely of said longitudinal axis and said power line along substantially the entire length of said power line, and resisting radial outward displacement of said wire rope strands, along substantially the entire length of said wire ropes, during longitudinal compression of said wire ropes, said means extending along said longitudinal axis and being bendable about an axis transverse thereto, said means comprising a pair of engaging channels.

4. A cable according to claim 3, wherein said means further comprises a pair of supports, each receiving one of said wire ropes therein and being located between said pair of channels.

5. A cable according to claim 4, wherein said pair of channels include retaining members rigidly engaging said supports.

6. A cable according to claim 4, wherein said means further comprises a tubular armor member enclosing and engaging said channels.

7. A cable according to claim 6, wherein said tubular support includes a plurality of spaced, transverse slots.

8. A cable having a longitudinal axis and comprising:

a pair of spaced apart wire ropes extending along said longitudinal axis, each wire rope comprising a plurality of helically wound strands and having an outer diameter D;

a power line located between said pair of wire ropes, extending along said longitudinal axis, and having an outer diameter at least equal to D; and means, coupled to and enclosing said wire ropes and said power line, for maintaining said wire ropes a fixed distance apart, resisting external compressive forces directed transversely of said longitudinal axis and said power line along substantially the entire length of said power line, and resisting radial outward displacement of said wire rope strands, along substantially the entire length of said wire ropes, during longitudinal compression of said wire ropes, said means extending along said longitudinal axis and being bendable about an axis transverse thereto, said means comprising a transversely rigid tubular support engaging each of said wire ropes.

9. A cable according to claim 8, wherein said tubular support has a pair of concave sections, said concave sections each receiving a portion of one of said wire ropes therein.

10. A cable according to claim 9, wherein said means further comprises a tubular armor member engaging and enclosing each of said wire ropes.

11. A cable according to claim 8, wherein said tubular support comprises parallel, spaced top and bottom planar sections and parallel, spaced left and right concave side sections.

12. A cable comprising:

tubular means defining an elongated cavity having a longitudinal length along an X axis, a transverse height along a Y axis, and a transverse width along a Z axis, these axes being mutually orthogonal, said tubular means being substantially rigid but bendable about the Z axis;

an armor layer rigidly enclosing and engaging said tubular means but being bendable about the Z axis;

a first wire rope located in said cavity and extending along the X axis;

a second wire rope located in said cavity, extending along the X axis and spaced from said first wire rope along the Z axis;

first support means, located in said cavity and receiving said first wire rope therein, for resisting external compressive forces directed along the Y and Z axes and for resisting compressive forces applied to said first wire rope along the X axis but being bendable about the Z axis;

second support means, located in said cavity, receiving said second wire rope therein and spaced from said first support means along the Z axis, for resisting external compressive forces directed along the Y and Z axes and for resisting compressive forces applied to said second wire rope along the X axis but being bendable about the Z axis;

at least one electrical conductor extending along the X axis in said cavity between said first and second support means;

retaining means, rigidly coupled to said tubular means and said first and second support means, for maintaining said first and second support means a fixed distance apart; and elastomeric filler means, located in said cavity, for filling the empty spaces therein.

13. A cable according to claim 12, and further comprising at least one hydraulic line extending along the X axis in said cavity.

14. A cable according to claim 13, wherein said at least one hydraulic line is located in said first wire rope.

15. A cable according to claim 12, and further comprising two hydraulic lines extending along the X axis in said cavity, one of said hydraulic lines being located in said first wire rope and the other of said hydraulic lines being located in said second wire rope.

16. A cable according to claim 12, and further comprising a hydraulic line extending along the X axis in said cavity and between said first and second support means.

17. A cable according to claim 12, and further comprising two hydraulic lines extending along the X axis in said cavity and between said first and second support means.

18. A cable according to claim 12, wherein said tubular means comprises an upper, substantially U-shaped channel and a lower, substantially U-shaped channel.

19. A cable according to claim 18, wherein said upper and lower channels engage one another.

20. A cable according to claim 12, wherein said first support means comprises a first elongated, corrugated member having a first passageway therein for receiving said first wire rope, and said second support means comprises a second elongated, corrugated member having a second passageway therein for receiving said second wire rope.

21. A cable according to claim 20, wherein said first passageway includes a first set of arcuate openings, each opening having a diameter substantially equal to the diameter of said first wire rope, and said second passageway includes a second set of arcuate openings, each opening having a diameter substantially equal to the diameter of said second wire rope.

22. A cable according to claim 12, wherein said first support means is corrugated, and said second support means is corrugated.

23. A cable according to claim 12, wherein said first support means comprises a first series of connected ridges and hollows and is extensible along the X axis, and said second support means comprises a second series of connected ridges and hollows and is extensible along the X axis.

24. A cable according to claim 23, wherein said retaining means engage the ridges in said first and second series of ridges and hollows.

25. A cable according to claim 12, wherein said armor layer comprises a tape applied to the outside of said tubular means.

26. A cable according to claim 12, wherein said first support means engages said tubular means, and said second support means engages said tubular means.

27. A cable according to claim 12, wherein said tubular means comprises an upper channel and a lower channel, said upper and lower channels engaging one another, said first support means engages said upper and lower channels, and said second support means engages said upper and lower channels.

28. A cable according to claim 12, wherein said first and second wire ropes are substantially parallel and are located adjacent the opposite sides of said tubular means located along the Z axis.

29. A cable according to claim 12, wherein the plane bisecting the transverse height of said cavity contains the longitudinal axes of said first and second wire ropes.

30. A cable according to claim 12, wherein said tubular means has a substantially rectangular cross section.

31. A cable according to claim 12, wherein said tubular means has a plurality of transverse slots therein.

32. A cable comprising:

an upper, substantially U-shaped channel, a lower, substantially U-shaped channel engaged with said upper channel to form an elongated cavity;

an armor layer rigidly enclosing and engaging said upper and lower channels;

a first corrugated support located in said cavity, engaging said upper and lower channels and having a first passageway;

a second corrugated support located in said cavity spaced from said first corrugated support, engaging said upper and lower channels and having a second passageway;

a first wire rope extending through said first passageway;

a second wire rope extending through said second passageway;

retaining means, rigidly coupled to said upper and lower channels and to said first and second supports, for maintaining said first and second supports a fixed distance apart;

at least one electrical conductor extending along said cavity between said first and second supports; and elastomeric filler means, located in said cavity, for filling the empty spaces therein.

33. A cable according to claim 32, wherein said cavity has a longitudinal length along an X axis, a transverse height along a Y axis and a transverse width along a Z axis, said first and second supports being rigid along the Y and Z axes to resist external compressive forces directed along the Y and Z axes and to resist compressive forces applied to said first and second wire ropes along the X axis.

34. A cable according to claim 33, wherein said first and second supports, said upper and lower channels, and said armor layer are bendable about the Z axis.

35. A cable according to claim 32, and further comprising a hydraulic line extending along said cavity.

36. A cable having a longitudinal axis and comprising:

a pair of spaced apart wire ropes extending along said longitudinal axis, each wire rope comprising a plurality of helically wound strands and having an outer diameter D;

a power line located between said pair of wire ropes and extending along said longitudinal axis; and means, coupled to and enclosing said wire ropes and said power line , for maintaining said wire ropes a fixed distance apart, resisting external compressive forces directed transversely of said longitudinal axis and said power line along substantially the entire length of said power line , and resisting radial outward displacement of said wire rope strands, along substantially the entire length of said wire ropes, during longitudinal compression of said wire ropes, said means extending along said longitudinal axis and being bendable about an axis transverse thereto, said means comprising a pair of transversely rigid tubular supports, each support engaging and enclosing one of said wire ropes and having an inner diameter substantially equal to D.

37. A cable according to claim 36, wherein said means defines a central longitudinally extending cavity receiving said power line therein, said power line being spaced from said means on all sides thereof and surrounded by elastomeric filler material interposed between said power line and said means, and extending substantially the entire length of said power line .

* * * * *